US011214464B2

(12) United States Patent
Ericson et al.

(10) Patent No.: US 11,214,464 B2
(45) Date of Patent: Jan. 4, 2022

(54) ELEVATOR SEISMIC PERFORMANCE APPARATUS

(71) Applicant: Otis Elevator Company, Farmington, CT (US)

(72) Inventors: Richard J. Ericson, Southington, CT (US); Bruce P. Swaybill, Farmington, CT (US); Meghan Mastriano, East Haven, CT (US); Loi Cheng, South Windsor, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 316 days.

(21) Appl. No.: 15/981,454

(22) Filed: May 16, 2018

(65) Prior Publication Data

US 2019/0352126 A1 Nov. 21, 2019

(51) Int. Cl.

| | |
|---|---|
| ***B66B 5/02*** | (2006.01) |
| ***B66B 7/02*** | (2006.01) |
| ***B66B 11/02*** | (2006.01) |

(52) U.S. Cl.

CPC ..... *B66B 5/022* (2013.01); *B66B 7/028* (2013.01); *B66B 11/0206* (2013.01); *B66B 11/0213* (2013.01); *B66B 11/0266* (2013.01)

(58) Field of Classification Search

CPC ..... B66B 5/022; B66B 7/028; B66B 7/04; B66B 7/046; B66B 7/047; B66B 7/048; B66B 11/0206; B66B 11/0213

See application file for complete search history.

(56) References Cited

U.S. PATENT DOCUMENTS

| | | | | |
|---|---|---|---|---|
| 1,076,273 A * | 10/1913 | Dunlap | B66B 7/047 187/409 |
| 3,856,117 A * | 12/1974 | Solymos | B66B 7/046 187/406 |
| 4,047,597 A | 9/1977 | Okura et al. | |
| 5,316,108 A | 5/1994 | Pearson | |
| 5,715,914 A * | 2/1998 | Traktovenko | B66B 7/044 187/406 |

(Continued)

FOREIGN PATENT DOCUMENTS

| | | |
|---|---|---|
| CN | 105084155 B | 3/2018 |
| JP | 54162350 A | 12/1979 |

(Continued)

OTHER PUBLICATIONS

European Search Report for European Application No. 19175004.1-1017; dated Mar. 31, 2020; 5 pages.

*Primary Examiner* — Minh Truong
(74) *Attorney, Agent, or Firm* — Cantor Colburn LLP

(57) ABSTRACT

An elevator car of an elevator system includes a car body, and a car frame supportive of the car body. The car frame includes two or more opposing upright assemblies, a cross-head assembly located above the car body, and a plank assembly located below the car body. A plurality of seismic retainers are located at each of the upright assemblies. The plurality of seismic retainers are configured for a non-contact relationship with a guide rail of the elevator system during normal operation of the elevator system, and configured to react guide rail loads during a sway event via contact with the guide rail.

9 Claims, 6 Drawing Sheets

(56) References Cited

U.S. PATENT DOCUMENTS

| | | | | |
|---|---|---|---|---|
| 6,345,698 | B1 * | 2/2002 | Ravishankar | B66B 7/046 187/409 |
| 7,455,151 | B2 * | 11/2008 | Perez | B66B 7/046 104/245 |
| 8,251,186 | B2 * | 8/2012 | Webster | B66B 7/04 187/401 |
| 8,441,615 | B2 | 5/2013 | Hashemi et al. | |
| 9,382,098 | B2 * | 7/2016 | Arai | B66B 7/046 |
| 9,469,505 | B2 | 10/2016 | Piech et al. | |
| 2005/0279588 | A1 * | 12/2005 | Fujita | B66B 7/044 187/393 |
| 2015/0239710 | A1 * | 8/2015 | Det | B66B 7/047 187/409 |
| 2016/0167924 | A1 * | 6/2016 | Roivainen | B66B 11/0213 187/401 |
| 2017/0057783 | A1 * | 3/2017 | Fargo | B66B 5/18 |
| 2019/0106292 | A1 * | 4/2019 | Zerelles | B66B 7/046 |

FOREIGN PATENT DOCUMENTS

| | | | |
|---|---|---|---|
| JP | S5772589 | A | 5/1982 |
| JP | 1135247 | A | 2/1999 |
| JP | 1135249 | A | 2/1999 |
| JP | H1129276 | A | 2/1999 |
| JP | 2000302356 | A | 10/2000 |
| JP | 2002338168 | A | 11/2002 |
| JP | 2011195252 | A | 10/2011 |
| JP | 2015054754 | A | 3/2015 |
| JP | 2015074537 | A | 4/2015 |
| WO | 2011039854 | A1 | 4/2011 |
| WO | 2011102008 | A1 | 8/2011 |
| WO | 2017108495 | A1 | 6/2017 |

* cited by examiner

ELEVATOR SEISMIC PERFORMANCE APPARATUS

BACKGROUND

Exemplary embodiments pertain to the art of elevator systems, and more particularly to improving elevator system performance during seismic events.

Elevator systems must typically comply with jurisdictional rules for performance of the elevator system under various operating conditions. Such rules are set forth in codes issued by various code setting bodies. Some such codes specify standards for performance and safety of the elevator system in the case of a seismic event. Current configurations for meeting seismic requirements can result in high rail and car frame loading during a seismic event, resulting in large guide rail sizes in order to meet the seismic performance requirements, thus greatly increasing cost of the elevator system. Such issues are exacerbated in high-rise elevator systems and those with double-deck elevator car structures.

BRIEF DESCRIPTION

In one embodiment, an elevator car of an elevator system includes a car body, and a car frame supportive of the car body. The car frame includes two or more opposing upright assemblies, a crosshead assembly located above the car body, and a plank assembly located below the car body. A plurality of seismic retainers are located at each of the upright assemblies. The plurality of seismic retainers are configured for a non-contact relationship with a guide rail of the elevator system during normal operation of the elevator system, and configured to react guide rail loads during a sway event via contact with the guide rail.

Additionally or alternatively, in this or other embodiments the seismic retainer includes a retainer slot having a retainer slot width greater than a blade width of the guide rail disposed in the retainer slot.

Additionally or alternatively, in this or other embodiments three or more seismic retainers are located at each upright assembly.

Additionally or alternatively, in this or other embodiments two or more car bodies are located between the cross head assembly and the plank assembly.

Additionally or alternatively, in this or other embodiments each upright assembly includes two or more vertically extending upright members, and a plurality of upright braces extending between the upright members.

Additionally or alternatively, in this or other embodiments the plurality of seismic retainers are located at the plurality of upright braces.

Additionally or alternatively, in this or other embodiments one or more elevator car guides are located at the elevator car and configured for contact with the guide rail during normal operating conditions of the elevator system.

In another embodiment, an elevator system includes one or more guide rails, and an elevator car operably connected to and movable along the one or more guide rails. The elevator car includes a car body and a car frame supportive of the car body. The car frame includes two or more opposing upright assemblies, a crosshead assembly located above the car body, and a plank assembly located below the car body. A plurality of seismic retainers are located at each of the upright assemblies. The plurality of seismic retainers are configured for a non-contact relationship with a guide rail of the elevator system during normal operation of the elevator system, and are configured to react guide rail loads during a seismic or rope sway event via contact with the guide rail.

Additionally or alternatively, in this or other embodiments the seismic retainer includes a retainer slot having a retainer slot width greater than a blade width of the guide rail located in the retainer slot.

Additionally or alternatively, in this or other embodiments three or more seismic retainers are located at each upright assembly.

Additionally or alternatively, in this or other embodiments two or more car bodies are located between the crosshead assembly and the plank assembly.

Additionally or alternatively, in this or other embodiments each upright assembly includes two or more vertically extending upright members, and a plurality of upright braces extending between the upright members.

Additionally or alternatively, in this or other embodiments the plurality of seismic retainers are located at the plurality of upright braces.

Additionally or alternatively, in this or other embodiments one or more elevator car guides are located at the elevator car configured for contact with the guide rail during normal operating conditions of the elevator system.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
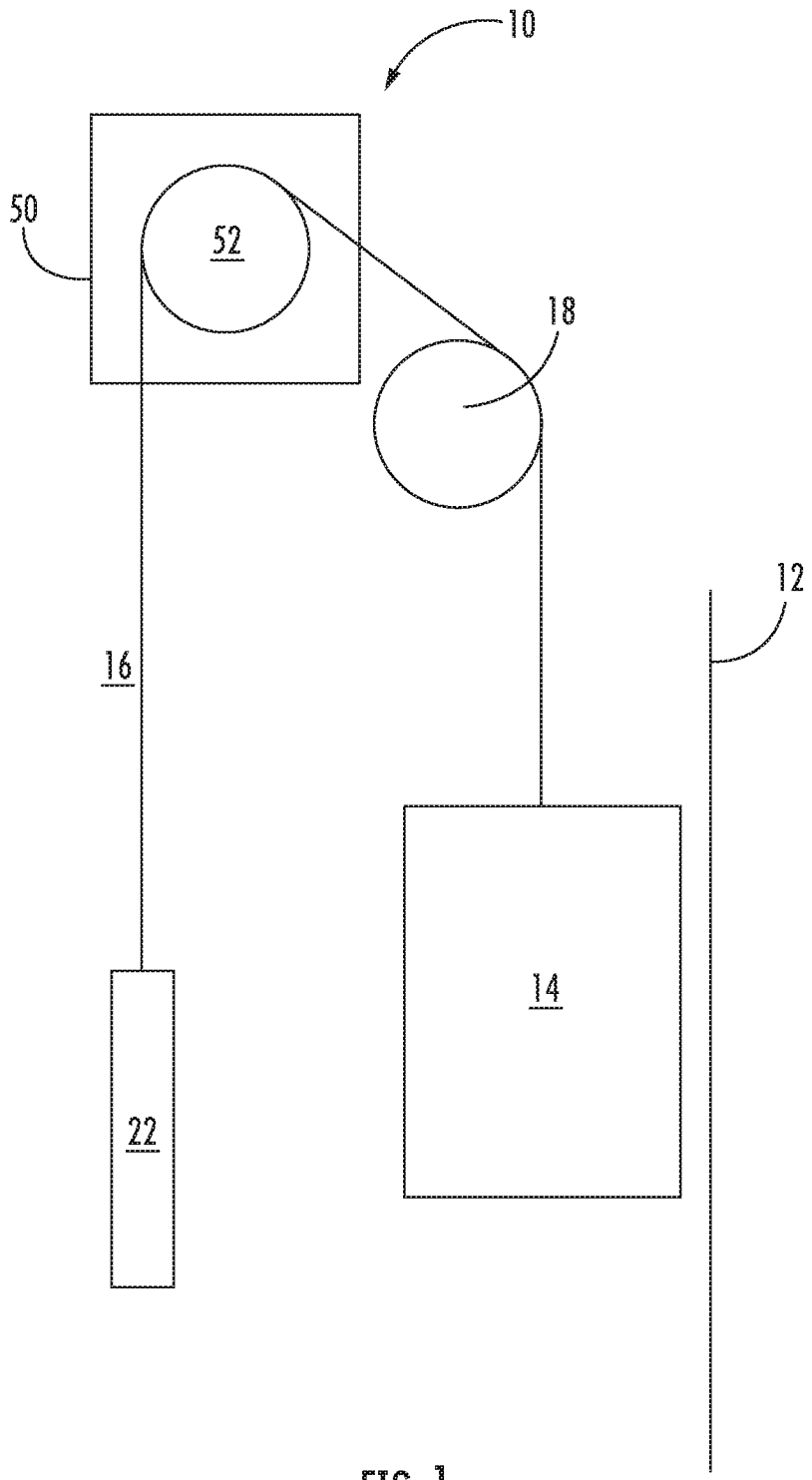
FIG. 1 is a schematic view of an embodiment of an elevator system.

Shown in FIG. 1 is a schematic view of an exemplary traction elevator system 10. The elevator system 10 includes an elevator car 14 operatively suspended or supported in a hoistway 12 with one or more load bearing members, such as a rope or a belt 16. The belt 16 interacts with sheaves 18 and 52 to be routed around various components of the elevator system 10. Sheave 18 is configured as a diverter, deflector or idler sheave and sheave 52 is configured as a traction sheave, driven by a machine 50. Movement of the traction sheave 52 by the machine 50 drives, moves and/or propels (through traction) the belt 16 that is routed around the traction sheave 52. Diverter, deflector or idler sheaves 18 are not driven by a machine 50, but help guide the belt 16 around the various components of the elevator system 10. The belt 16 could also be connected to a counterweight 22, which is used to help balance the elevator system 10 and reduce the difference in belt tension on both sides of the traction sheave 52 during operation. The sheaves 18 and 52 each have a diameter, which may be the same or different from each other.

In some embodiments, the elevator system 10 could use two or more belts 16 for suspending and/or driving the elevator car 14 In addition, the elevator system 10 could have various configurations such that either both sides of the one or more belts 16 engage the sheaves 18, 52 or only one side of the one or more belts 16 engages the sheaves 18, 52. The embodiment of FIG. 1 shows a 1:1 roping arrangement in which the one or more belts 16 terminate at the car 14 and counterweight 22, while other embodiments may utilize other roping arrangements.

Figure 2:
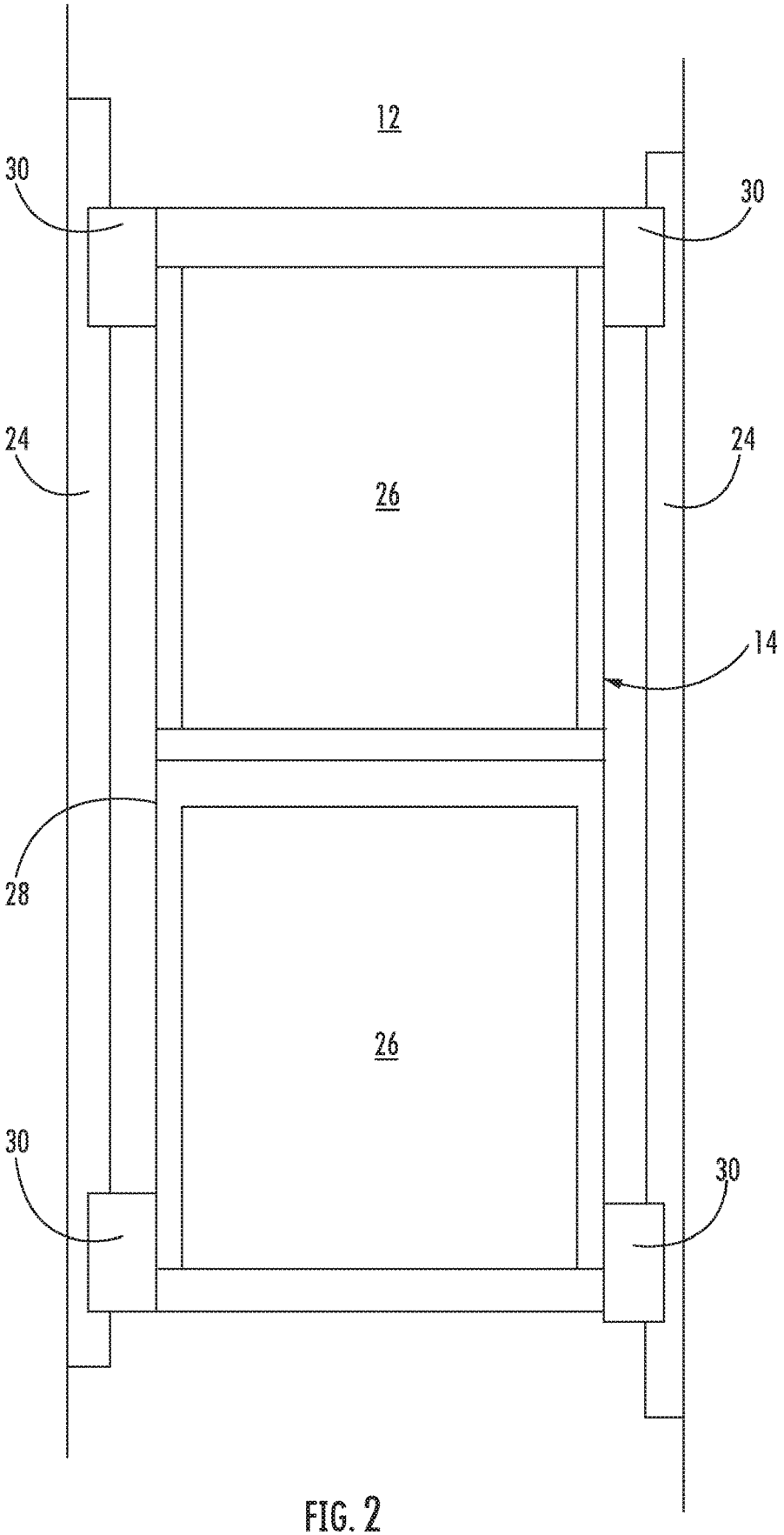
FIG. 2 is another schematic view of an embodiment of an elevator system.

Referring to FIG. 2, the elevator car 14 travels in the hoistway 12 along a path of one or more guide rails 24 arranged in the hoistway 12. In the embodiment of FIG. 2, two guide rails 24 located at opposing sides of the elevator car 14 are utilized, but it is to be appreciated that in other embodiments other numbers of guide rails 24 may be utilized, such as one or four guide rails 24. The elevator car 14 includes a car body 26 affixed to a car frame 28. In some embodiments, such as illustrated in FIG. 2, the elevator car 14 is a double deck configuration, with two car bodies 26 affixed to a common car frame 28. While the embodiments disclosed herein include two car bodies 26 affixed to the car frame 28, it is to be appreciated that the present disclosure may be utilized with other elevator car 14 configurations, such as those with one car body 26 or three or more car bodies 26 affixed to a common car frame 28.

Figure 3:
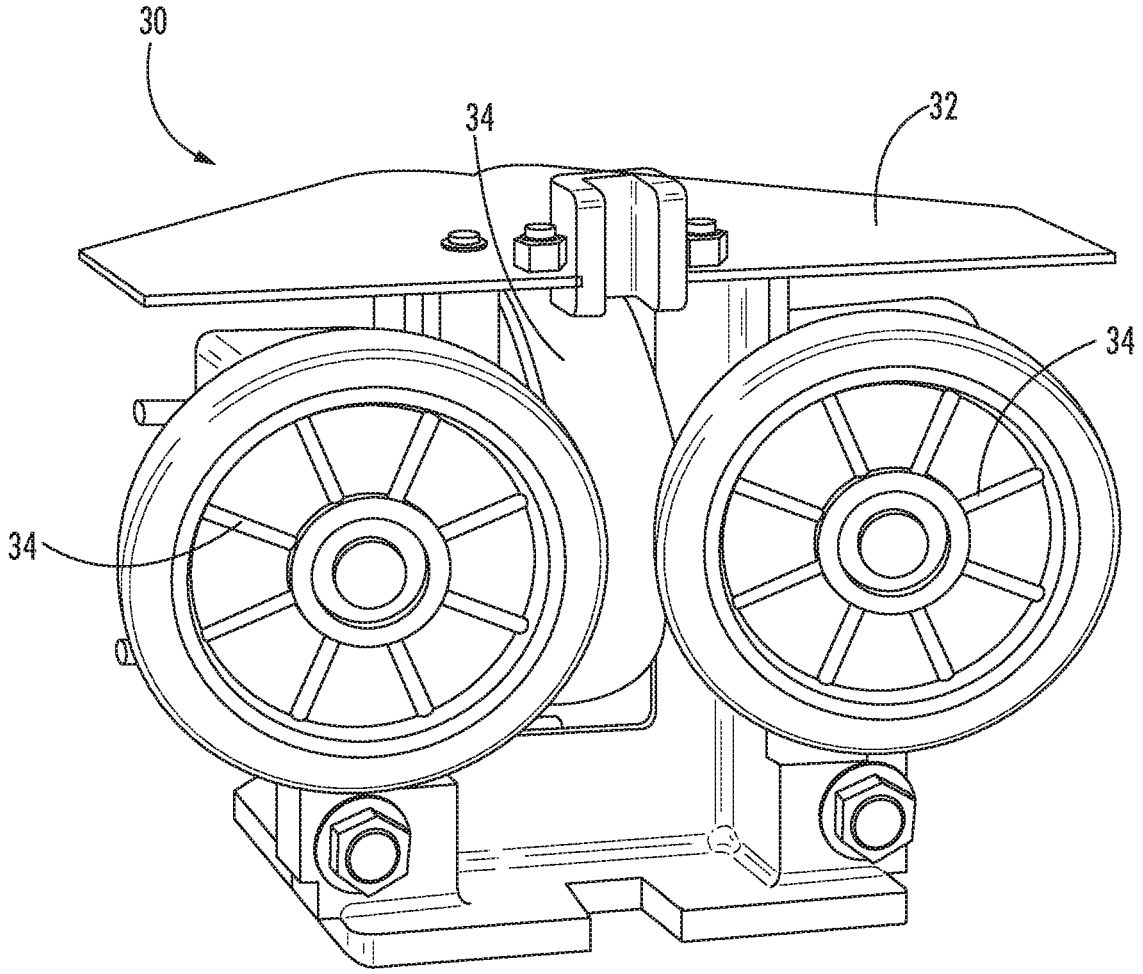
FIG. 3 is a perspective view of an embodiment of an elevator car guide of an elevator system.

Car guides 30 mounted at the elevator car 14 interact with the guide rails 24, thereby guiding the elevator car 14 along the path of the guide rails 24. In some embodiments, such as shown in FIG. 2, the elevator car 14 includes four car guides 30, with two car guides 30 located to be interactive with each of the guide rails 24. As shown in FIG. 3, the car guide 30 includes a guide base 32 fixed to the elevator car 14. A plurality of guide wheels 34 are secured to the guide base 32. As the elevator car 14 travels along the hoistway 12, the guide wheels 34 remain in contact with the guide rail 24.

Figure 4:
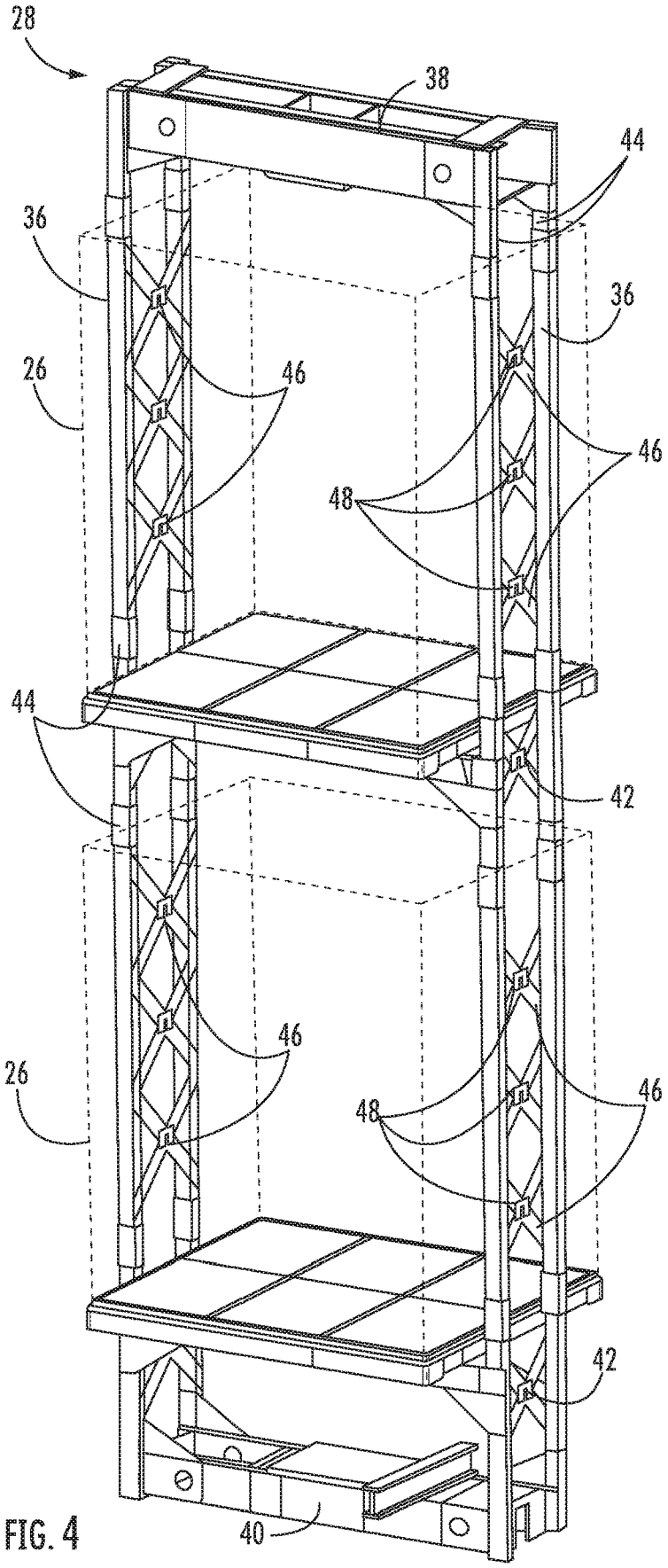
FIG. 4 is a perspective view of an embodiment of a car frame of an elevator system.

Referring now to FIG. 4, the car frame 28 is illustrated in more detail. The car frame 28 includes a side frame 36 or upright assembly at each lateral side of the car frame 28, with a crosshead assembly 38 and a plank assembly 40 extending between the side frames 36 and defining an upper extent and a lower extent, respectively, of the car frame 28. Intermediate cross members 42 support the car bodies 26 in the car frame 28. The side frame 36 includes upright members 44 and upright braces 46 connecting the upright members 44 to provide support to the upright members 44. A plurality of seismic retainers 48 are located along the side frames 36 to react loads during seismic events or other sway events. In some embodiments, such as in FIG. 4, the seismic retainers 48 are located at the upright braces 46, while in other embodiments the seismic retainers 48 may be positioned at other locations, such as at the upright members 44. While 8 seismic retainers 48 are illustrated at the side frame 36 of FIG. 4, it is to be appreciated that other quantities of seismic retainers 48 may be utilized. In some embodiments, three or more seismic retainers 48 are utilized. Further, in other embodiments, the side frame 36 includes a single upright member 44 with the seismic retainers 48 secured to the upright member 44.

Figure 5:
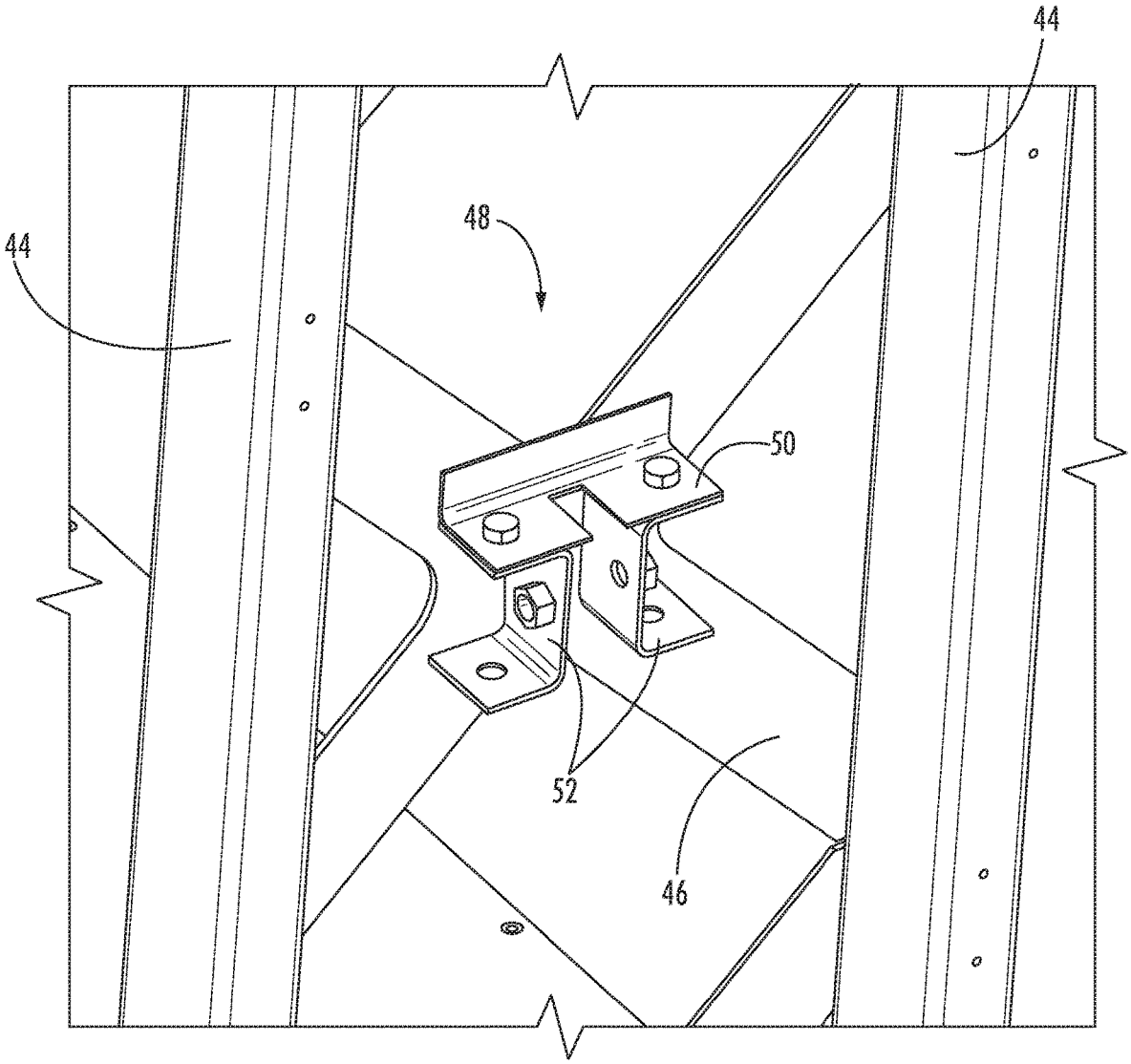
FIG. 5 is a perspective view of an embodiment of a seismic retainer for an elevator car.
Figure 6:
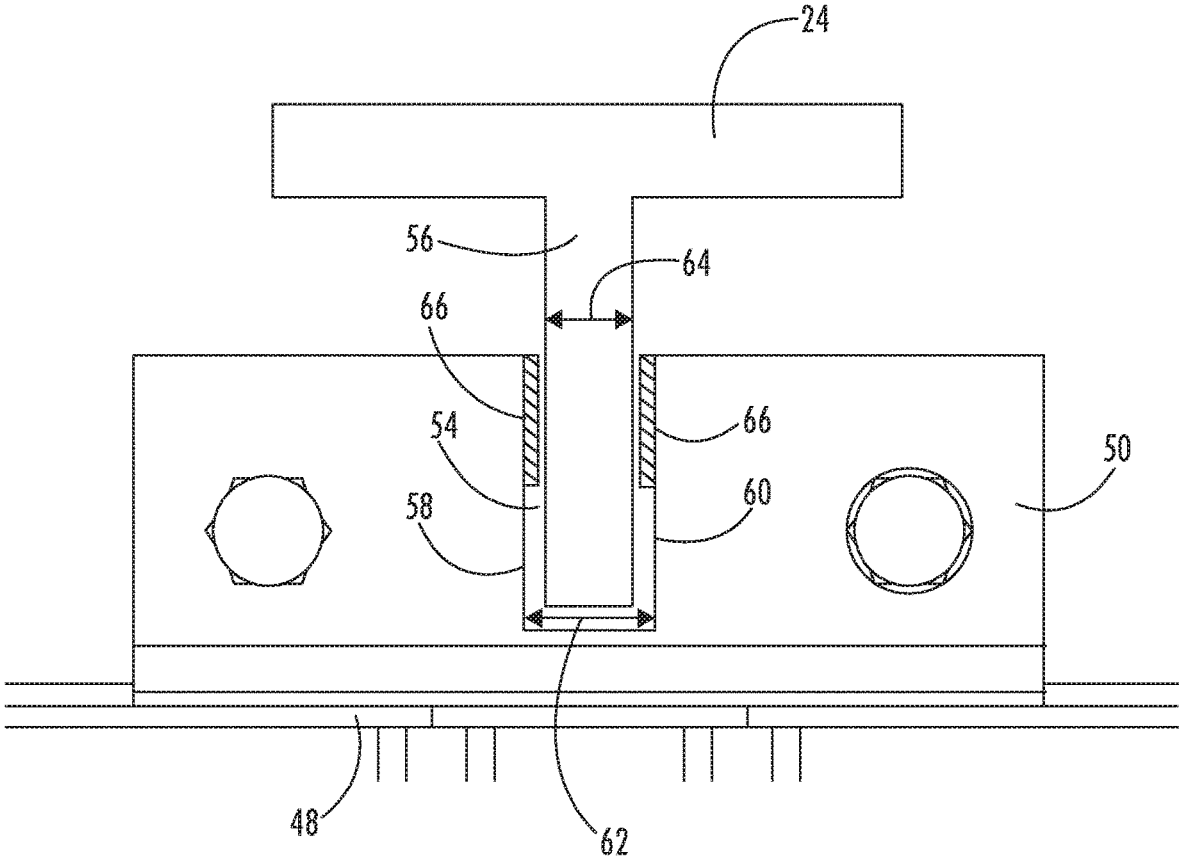
FIG. 6 is a plan view of an embodiment of a seismic retainer for an elevator car.

Referring now to FIG. 5, the seismic retainer 48 includes a retainer plate 50 secured to the upright brace 46 via two retainer brackets 52. As shown best in FIG. 6, the retainer plate 50 includes a rail slot 54 sized and positioned for a non-contact relationship with the guide rail 24 during normal operating conditions of the elevator system 10. A rail blade 56 of the guide rail 24 is located in the rail slot 54 between a first slot side 58 and a second slot side 60 opposite the first slot side 58. The first slot side 58 and the second slot side 60 define a rail slot width 62, which is greater than a blade width 64 of the rail blade 56. During a seismic event or other building sway event including lateral accelerations of the elevator car 14, the seismic retainer 48 reacts guide rail loads via contact with the guide rail 24 during the event, and by providing a plurality of seismic retainers 48 the guide rail loads are distributed throughout the plurality of seismic retainers 48. Although a plurality of retainer plates 50 are utilized in the illustrated embodiments, it is to be appreciated that in other embodiments one or more intermediate roller guides or sliding guides may be substituted for any of the seismic retainers 48, to further help distribute loading on the rails for either a seismic loading event, or with normal running conditions to help reduce deflections of car frame 28 structure.

Depending on the system requirements, a quantity and/or spacing of the seismic retainers 48 may be varied. Further, properties of the seismic retainer 48, such as rail slot width 62 or retainer plate 50 thickness may be varied to meet elevator system 10 requirements. Further, wear pads 66 may be included in the rail slot 54 to mitigate wear and noise due to contact between the guide rail 24 and the retainer plate 50.

Use of the seismic retainers 48 allows for reduction in guide rail 24 size, and/or reduces the quantity of rail brackets necessary to fix the guide rail 24 in the hoistway 12 for sway event load reaction. These material reductions, which are especially significant in high rise elevators, such as those having hoistways 12 of 100 meters or more, and results in a significant cost savings for the elevator system 10.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator car of an elevator system, comprising:

a car body;

a car frame supportive of the car body, the car frame including:

two or more opposing upright assemblies;

a crosshead assembly disposed above the car body; and a plank assembly disposed below the car body;

two or more elevator car guides disposed at the elevator car configured for contact with the guide rail during normal operating conditions of the elevator system; and a plurality of seismic retainers affixed directly to each of the upright assemblies, separate and spaced apart from the two or more elevator car guides, the plurality of seismic retainers configured for a non-contact relationship with a guide rail of the elevator system during normal operation of the elevator system, and configured to contact the guide rail during a seismic or rope sway event thus reacting loads applied to the guide rail during the seismic or rope sway event;

wherein an elevator car guide of the two or more elevator car guides is disposed at each vertical end of the car frame;

wherein each upright assembly includes:

two or more vertically extending upright members; and, a plurality of upright braces extending between the upright members; and wherein two upright braces of the plurality of upright braces intersect between the upright members; and wherein a seismic retainer of the plurality of seismic retainers is disposed at an intersection of the two upright braces.

2. The elevator car of claim 1, wherein the seismic retainer includes a retainer slot having a retainer slot width greater than a blade width of the guide rail disposed in the retainer slot.

3. The elevator car of claim 2, further comprising one or more wear pads disposed in the retainer slot.

4. The elevator car of claim 1, wherein three or more seismic retainers are disposed at each upright assembly.

5. The elevator car of claim 1, further comprising two or more car bodies disposed between the cross head assembly and the plank assembly.

6. An elevator system, comprising:

one or more guide rails;

an elevator car operably connected to and movable along the one or more guide rails, the elevator car including:

a car body;

a car frame supportive of the car body, the car frame including:

two or more opposing upright assemblies;

a crosshead assembly disposed above the car body; and a plank assembly disposed below the car body;

two or more elevator car guides disposed at the elevator car configured for contact with the guide rail during normal operating conditions of the elevator system; and a plurality of seismic retainers affixed directly to each of the upright assemblies, separate and spaced apart from the two or more elevator car guides, the plurality of seismic retainers configured for a non-contact relationship with a guide rail of the elevator system during normal operation of the elevator system, and configured to contact the guide rail during a seismic or rope sway event thus reacting loads applied to the guide rail during the seismic or rope sway event;

wherein an elevator car guide of the two or more elevator car guides is disposed at each vertical end of the car frame;

wherein each upright assembly includes:

two or more vertically extending upright members; and, a plurality of upright braces extending between the upright members; and wherein two upright braces of the plurality of upright braces intersect between the upright members; and wherein a seismic retainer of the plurality of seismic retainers is disposed at an intersection of the two upright braces.

7. The elevator system of claim 6, wherein the seismic retainer includes a retainer slot having a retainer slot width greater than a blade width of the guide rail disposed in the retainer slot.

8. The elevator system of claim 6, wherein three or more seismic retainers are disposed at each upright assembly.

9. The elevator system of claim 6, further comprising two or more car bodies disposed between the crosshead assembly and the plank assembly.

* * * * *